United States Patent [19]

Fulton et al.

[11] Patent Number: 4,796,403

[45] Date of Patent: Jan. 10, 1989

[54] ARTICULATING ROOFING PANEL CLIP

[75] Inventors: David A. Fulton, Humble; Jerry D. Boen, Houston, both of Tex.

[73] Assignee: Metal Building Components Incorporated, Houston, Tex.

[21] Appl. No.: 90,705

[22] Filed: Aug. 28, 1987

[51] Int. Cl.[4] ..... E04D 1/34

[52] U.S. Cl. ..... 52/713; 52/478; 52/512; 52/545

[58] Field of Search ..... 52/478, 506, 509, 511, 52/512, 520, 528, 544–547, 713, 235

[56] References Cited

U.S. PATENT DOCUMENTS

| | | | |
|---|---|---|---|
| 2,877,875 | 3/1959 | Bolt | 52/713 |
| 3,640,043 | 2/1972 | Querfeld et al. | 52/508 |
| 4,034,532 | 7/1977 | Reinwall, Jr. | 52/520 |
| 4,070,835 | 1/1978 | Reverend et al. | 52/235 |
| 4,296,581 | 10/1981 | Heckelsberg | 52/520 |
| 4,495,743 | 1/1985 | Ellison et al. | 52/478 |
| 4,514,952 | 5/1985 | Johansson | 52/713 |
| 4,522,005 | 6/1985 | Seaburg et al. | 52/544 |
| 4,575,983 | 3/1986 | Lott, Jr. et al. | 52/544 |

OTHER PUBLICATIONS

"Standing Seam Roof", 2 page synopsis of applicants' major competitors, 1–1985.

"The Standing Seam Roof System" by Nucor Building Products (publication no. 07610/NUC), pp. 1–15.

"Zip-Rib Inc. Roofing and Siding" (publication no. 07610/ZIP), pp. 1–8.

"StarShield: The Rugged Roof System that Resists Weather and Saves Energy" by the Star Manufacturing Company (publication no. 07610/STA), 2 pages front & back.

Publication bearing No. 13.2a/Ch (Col. 2, first paragraph), one page.

Publication bearing No. 13.2a/Ar, one page.

Publication entitled "Installation Information" by Engineered Components Incorporated, pp. 1–5.

"Product Review" from Rural Builder Magazine, Jul. 1986, (Col. 1, seventh paragraph), one page.

Publication bearing no. 13.2a/But (Col. 1, first partial paragraph), one page.

"Starshield" publication, "Clip Detail", one page.

"VP Roof Systems" publication, one page.

"Metal Walls, Roofing and Fascia" by Architectural Panels, Inc. (publication no. 07410/ARC), pp. 1–16.

"Roof Systems" (no. 13.2a/Arm), (Col. 1, last paragraph), one page.

(List continued on next page.)

*Primary Examiner*—David A. Scherbel

*Assistant Examiner*—Andrew Joseph Rudy

*Attorney, Agent, or Firm*—Arnold, White & Durkee

[57] ABSTRACT

An improved clip for supporting standing seam roofing panels on purlins or joists is disclosed. When used, this unique clip will not only support a standing seam, formed by two adjacent, connecting roofing panels, on a purlin, but will also accommodate both rotational and translational movement of the panels relative to the purlin. The disclosed clip is formed with several basic components: a base which is attachable to a purlin or joist; a middle piece which is capable of rotational displacement relative to the base; and a moveable top piece which is capable of translational, sliding movement relative to the middle piece. When in use, the top piece of the clip will coact with the interior of the standing seam to form a substantially tight, non-moving union with the seam. The base of the clip will be attached to the joist or purlin to support the roofing panels. When so situated, the novel clip according to the present invention may accommodate both translational, longitudinal movement of the roofing panels (which may be caused by thermal expansion or contraction of the panels), and rotational movement of the roofing panels (which may be caused by the application of live or dead loads on the panels), relative to the purlin. Further, a clip according to the present invention may also be used to attach standing seam roofing panels to joists or purlins which are not level, which have flanges out of square with the web of the purlin, or which are misaligned with the remaining purlins.

14 Claims, 3 Drawing Sheets

OTHER PUBLICATIONS

"Roof Systems" (no publication number; the numeral "6" appears at bottom left of page), (Col. 1, second paragraph.), one page.

"Weather Roof" (no publication number; an umbrella logo appears at the upper left corner of page), p. 6.

"Structural Architectural Panels" by Roof Systems, Inc. (publication no. 07610/ROO), 4 pages, front & back of each page.

"Butler Standing Seam Roof Systems" by the Butler Manufacturing Company (publication no. 07610/BUT), pp. 1–8.

"Weather Seam–24" by ASC Pacific Inc. (publication no. 07610/ASC), 2 pages front and back.

"Armco Roof Systems" by Armco Building Systems (publication no. 07610/ARM), pp. 1–8.

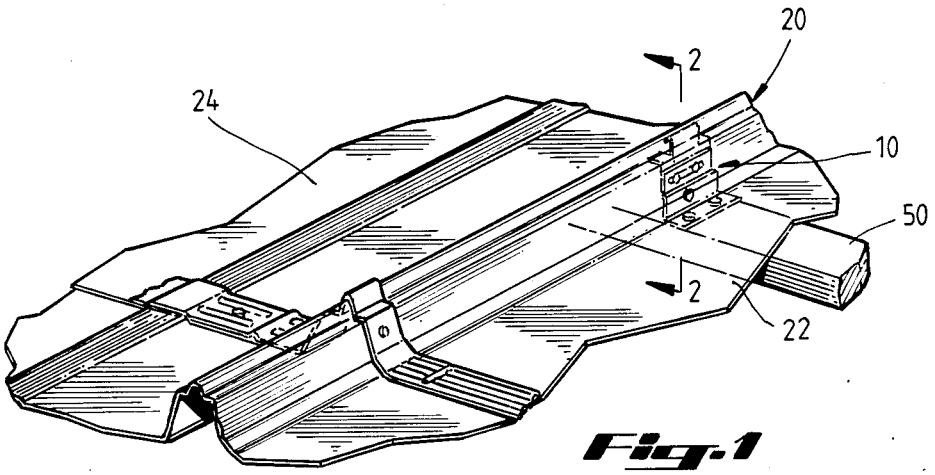
Fig. 1
Fig. 2
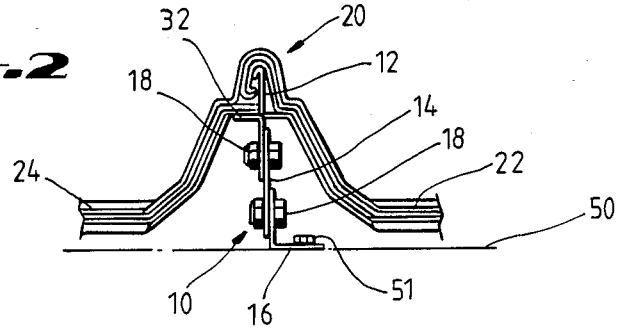
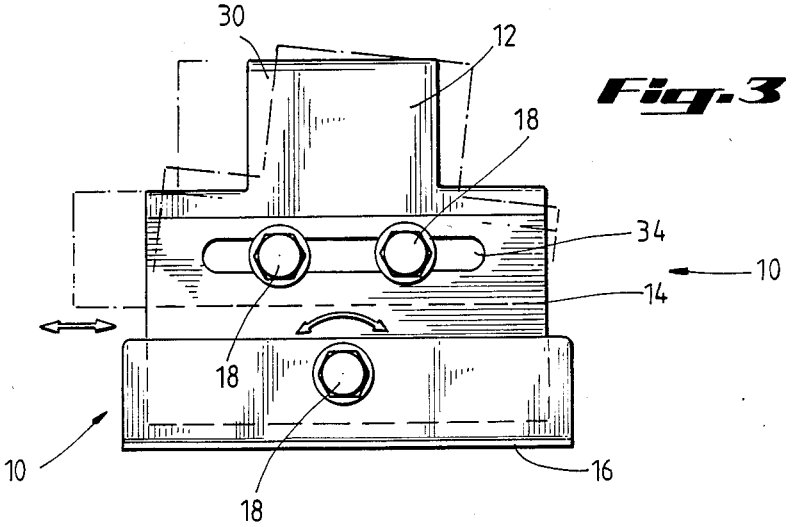
Fig. 3

60
62
64
66
70
72
74
76
78
80
82
84
86

ARTICULATING ROOFING PANEL CLIP

BACKGROUND OF THE INVENTION

There are many possible ways to provide a roof for a structure. One possible way to roof a structure is through the use of roofing panels. The art of roofing structures with roofing panels has advanced to the use of standing seam metallic roofing panels. Standing seams are formed when raised longitudinal edges of roofing panels are joined together to form a longitudinal ridge running from the peak to the eave line of the roof.

Standing seam metallic roofing panels are normally manufactured from GALVALUME TM steel and may be painted or coated with a protective film to protect them from oxidation or corrosion. However, other materials may easily be used to form panels of sufficient strength and flexibility so as to be useful in roofing a structure. The individual panels may vary in width from one to two feet, and may be up to forty-five feet in length.

In erecting a structure, walls or columns of the structure are first built. Rafters, which form the primary roof support, are carried by the walls or columns. These rafters usually span the width of the structure. Joists or purlins are located across the rafters and are supported by the rafters. Joists or purlins are normally installed perpendicular to the rafters, thereby defining the roof line. The purlins normally extend along the length of the building. Insulation may conveniently be laid across the purlins or joists.

A standing seam roofing system may be installed on the purlins. Roofing panels are joined together along adjacent longitudinal sides in a male/female relationship to form the standing seams.

In the past, various devices have been employed to attach the standing seam roofing panels to the purlins. It is well known in the art that it is advantageous to support and attach the roofing panels to the purlins along the standing seams formed by the raised longitudinal edges of adjacent roofing panels.

A clip is a device used to support the roofing panels, and attach the panels to the purlins and hence the structure itself. However, the clips known in the art have all been characterized by a common drawback. All of the clips according to the prior art are flawed in that they do not provide for sufficient flexibility or movement of the roofing panels relevant to the purlins.

During construction of the roof, and periodically after the roof has been completed, the roofing panels on the roof experience loads which cause the panels to move rotationally relative to the normally rigid purlins. Typically, these loads are caused by workers walking on the roof but may also be caused by environmental loading such as that caused by wind, rain, or snow. Further, when metallic roofing panels are used, the roofing panels will expand and contract due to climate changes. This constant thermal expansion and contraction causes the roofing panels to move longitudinally, or translationally, relative to the rigid purlins positioned below.

Further, during assembly of the standing seam roof on a structure, the roofing panels will often be displaced by workers assembling the panels. This constant displacement, or jostling, may cause the panels to bend or destroy the clips.

Also, when purlins or joists are installed on a structure, they are sometimes not positioned in proper alignment with the other purlins. Further, according to industry standards, as set forth in the Metal Building Systems Manual published by the Metal Building Manufacturers Association, the flanges of the purlins may be manufactured up to 3° out of the square with the web of the purlins. Therefore, the flanges of the purlins may be manufactured to be between 87° and 93° relative to the web. This industry accepted tolerance, by itself, and especially when coupled with improper alignment of the purlins on the stucture itself has, in the past, caused serious problems when a standing seam roofing system is later installed on the structure.

The problem being that it is very difficult to attach a standing seam, formed by two adjacent roofing panels, to a flange of a purlin that is neither perpendicular to the standing seam, nor positioned in a plane parallel to the ridge of the standing seam. Even if the standing seam is attached to the purlin, it will be incapable of accommodating expansion and contraction experienced by the metallic roofing panels.

One solution, now well known in the art, has been provide a clip, a portion of which is able to slide back and forth relative to the purlin. However, these sliding clips have also been marked by serious disadvantages. If the purlins supporting the roofing system are misaligned or manufactured with the web of the purlin being out of square with a flange of the purlin, as outlined above, these known sliding clips have been incapable of any sliding movement whatsoever. Typically the friction experienced in the moving pieces of these prior-art, sliding clips has been so great that for all purposes they fail to slide once the roof is in place. Therefore, when the roofing panels experience loads, or movement due to thermal expansion and contraction, the panels bend the clips, or the clips fail to move with the panels and destroy sealant positioned between the panels, thereby causing the roofing system to leak.

Thus, the prior art clips have demonstrated various disadvantages which have heretofore not been overcome.

SUMMARY OF THE INVENTION

The present invention overcomes the previously unsolved problems with the prior art and provides an improved clip which is capable of allowing roofing panels to move both translationally and/or rotationally relative to the substantially stationary purlins.

Further, the present invention provides a clip, or bracket, which is easily interchangeable with all of the clips currently known in the art, and which may be used to support various types and styles of standing seam roofs. In accordance with the present invention, a clip is comprised of several different components which interact to provide a clip which will allow the roofing panels to slide and rock relative to the rest of the structure. Further, contrary to the cumbersome clips known in the art, the clip according to the present invention may be installed quickly and easily to provide a secure, yet flexible connection between roof panels and purlin.

According to the present invention, the articulating clip is generally "L-shaped". The vertical portion of the "L" is formed by a moveable top piece and a middle movement facilitating piece. According to the present invention, the top piece is configured to engage a portion of the interior of a standing seam, to thereby securely connect the standing seam to the clip.

In a preferred embodiment of the invention, the top piece may also be provided with a pair of horizontally extending shoulders which provide additional support to the interior of the standing seam, and aid in transferring load acting on the roof to the purlin positioned below the clip.

In another preferred embodiment of the invention, the top piece is provided with a single horizontally extending shoulder that extends all the way across a vertical face of the top piece.

The moveable top piece of the clip is configured so that the top piece is able to slide longitudinally, in a vertical plane, relative to the middle piece and therefore relative to the purlin. According to the present invention, the top piece interacts with the middle piece so that the two pieces may slide relative to one another with a minimal amount of friction. The middle movement facilitating portion of the clip is in turn attached to the base of the clip, which is itself generally "L-shaped" in profile.

The middle movement facilitating portion of the clip allows a clip according to the present invention to compensate for poorly positioned purlins installed on the structure, and to compensate for flanges of purlins being manufactured within industry accepted tolerances but out of square with the web of the purlin. Thus, if a purlin is rotated out of alignment, is misaligned, or if a flange of the purlin is out of square with the web of the purlin, the clip according to the present invention may compensate for inexact purlin position or fabrication.

The base of the clip is formed so that a first "leg" of the "L" extends vertically upwardly, while a second leg of the "L" extends horizontally in a direction generally opposite to the horizontally extending shoulder of the top piece. The middle movement facilitating portion of the clip, and therefore the composite assembly of the top piece and middle piece, is attached to the upstanding vertical portion of the base so that the middle movement facilitating piece is capable of rotational movement in a vertical plane relative to the base. Therefore, the base of the clip not only serves to anchor the clip securely to the purlin, but also provides support for the remaining clip components.

In one preferred embodiment of the invention, the several components of the clip are connected by means of suitable fasteners.

In another embodiment of the present invention, the several components of the clips are connected to one another by means of riveted connections. However, no matter what connecting means are used to connect the components of the clip according to the present invention, it is essential that the moveable top piece be capable of translational movement relative to the middle movement facilitating piece, while the middle movement facilitating piece be capable of rotational movement relative to the base of the clip.

The present invention also includes a method aspect which involves supporting a standing seam roofing system on purlins or joists using improved clips according to the present invention.

BRIEF DESCRIPTION OF THE DRAWINGS

FIG. 1 is an overall perspective view of a standing seam roofing system installed on a structure, with an improved clip according to the present invention used to attach the standing seam to a purlin of the structure.

FIG. 2 is a cross section view of FIG. 1.

FIG. 3 is a view of the back of a clip according to the present invention with the articulation capabilities of the clip shown in phantom.

DETAILED DESCRIPTION OF THE PREFERRED EMBODIMENTS

Figure 4:
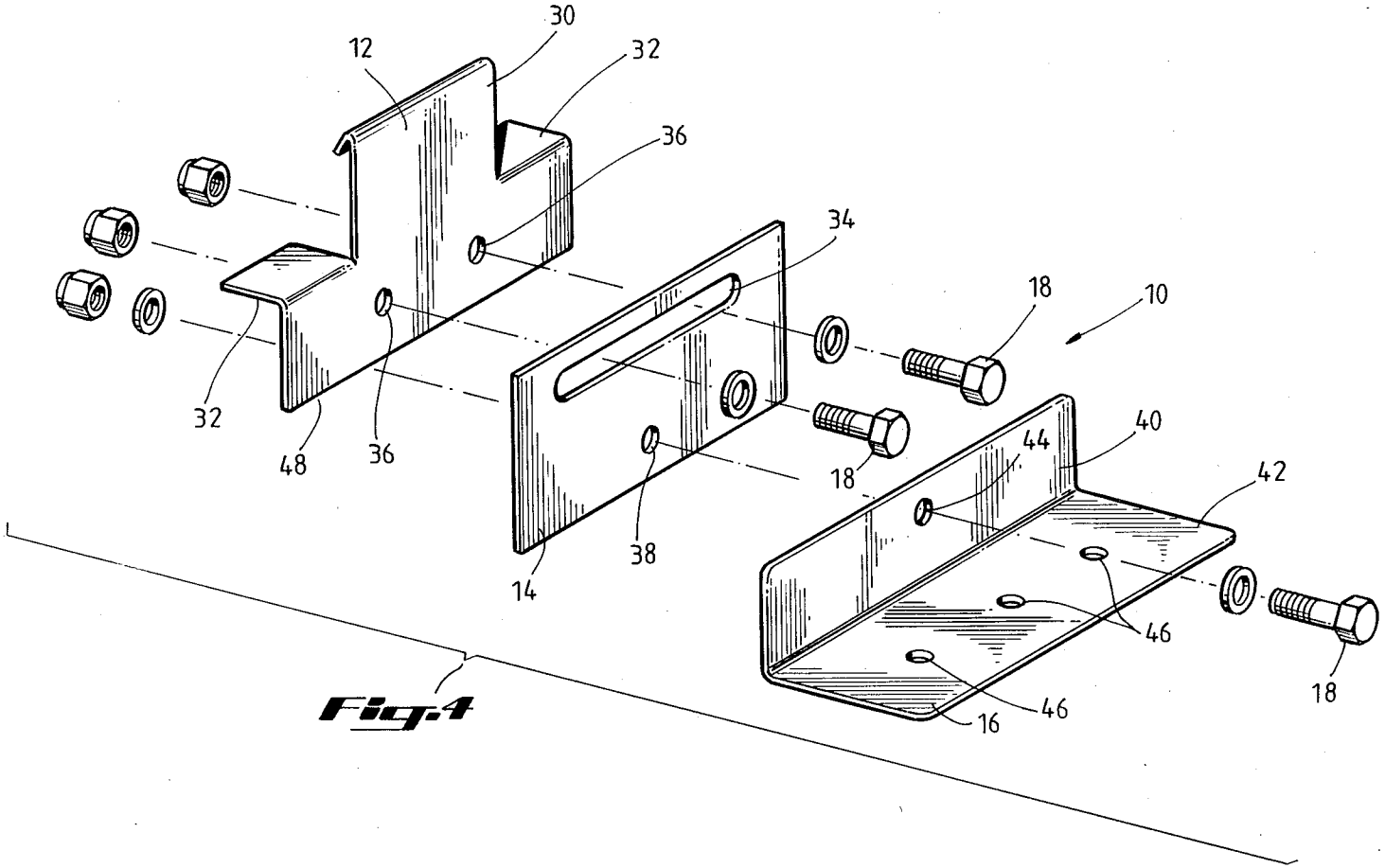
FIG. 4 is an exploded perspective view of an improved clip according to the present invention, wherein all the components of the clip are clearly shown.

Referring to FIG. 4, a clip 10 according to the present invention is comprised of several different types of components: a moveable top piece, or upper support structure, 12; a middle movement facilitating piece, or articulating bearing member, 14; a rigid base 16; and connecting means 18, used to connect the several components together.

The details of the moveable top piece 12 will be discussed first. Referring to FIGS. 3 and 4, each moveable top piece 12 is configured to engage a portion of the interior of a standing seam formed by adjacent roofing panels. The top piece, or upper support structure 12, also provides support to one of the roofing panels forming the standing seam. In one embodiment of the invention, the upper support structure 12 may be a vertically positioned member having an upper, vertically extending portion 30. The upper vertically extending portion 30 may be hook shaped at its uppermost edge in order to easily engage the interior surface of a standing seam. According to the present invention, a pair of opposed apertures 36 will be provided in the bottom portion of the moveable top piece 12. These apertures 36 will be used to accommodate connecting means 18 so that the moveable top piece 12 may be slidably connected to a middle movement facilitating piece 14.

In a preferred embodiment of the present invention, apertures 36 will generally be in opposed relation and will be symmetrically placed about the vertical center line of the top piece 12. Apertures 36 will be positioned proximate the bottom edge 48 of the top piece 12.

In yet another preferred embodiment of the present invention, the upper support structure 12 may be provided with outwardly extending, substantially horizontal shoulders 32. The horizontally extending shoulders 32 are configured to support at least a portion of the interior surface of roofing panel forming a standing seam. In this manner, a clip 10 according to the present invention will provide a strong, secure connection between the standing seam formed by a pair of adjacent metallic roofing panels and a purlin extending beneath the metallic panels. In this embodiment of the invention, the combined width of the opposed shoulders 32 will generally be less than half of the entire width of the moveable top piece 12. Further, in this embodiment of the invention, the horizontally extending shoulders 32 will project outwardly from a common face of the top piece 12 at substantially right angles to the body of top piece 12.

Figures 5, 6, 7:
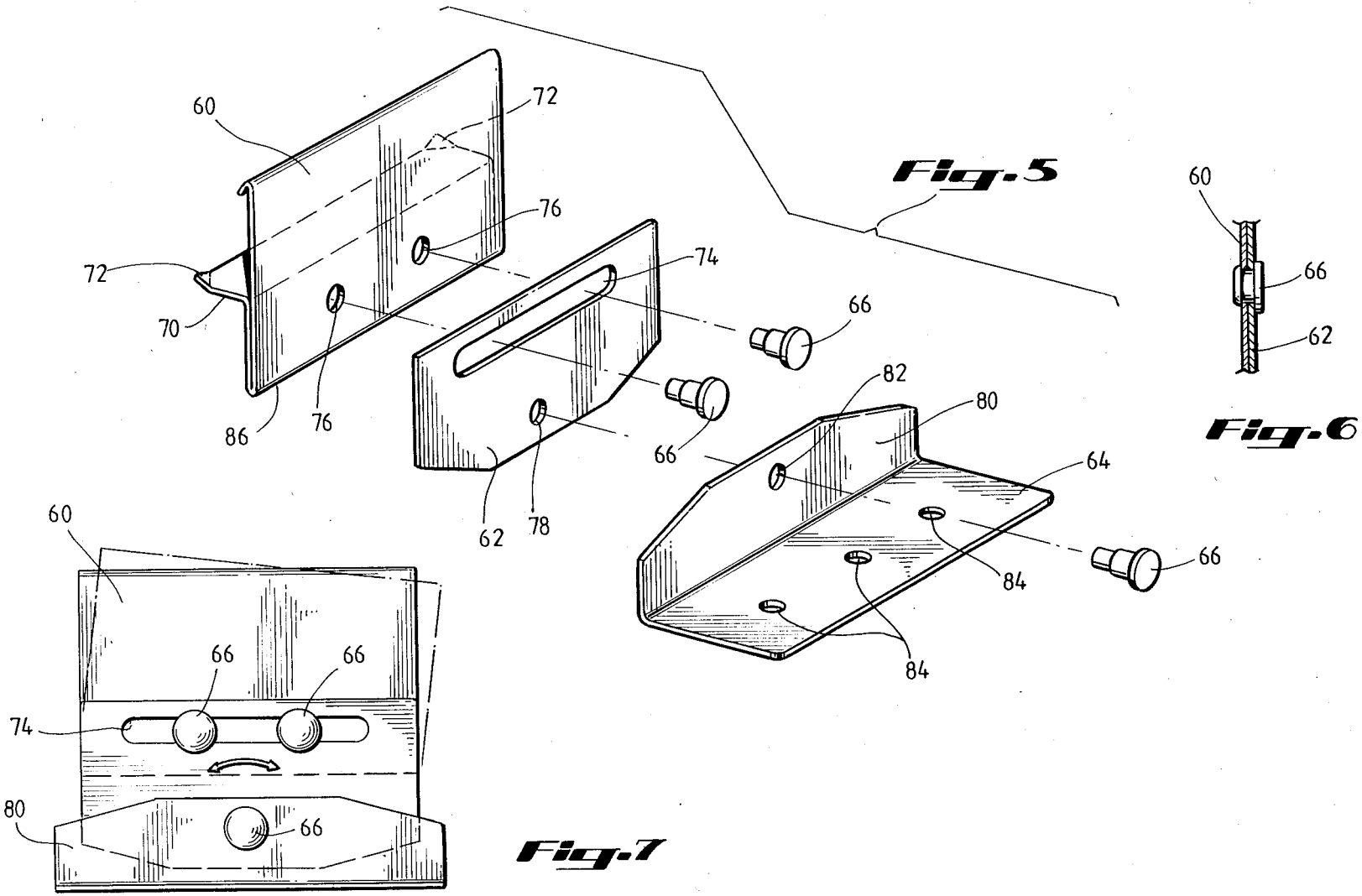
FIG. 5 is an exploded perspective view of another embodiment of the improved clip according to the present invention, wherein all the components of the clip are clearly shown.
FIG. 6 is a sectional view of the end of a portion of the clip depicted in FIG. 3.
FIG. 7 is a view of the back of a clip according to the present invention which is depicted in FIG. 6, and wherein all the articulation capabilities of the clip are shown.

Referring now to FIGS. 5 through 7, yet another embodiment of the present invention is disclosed. In this embodiment, and referring specifically to FIG. 5, the upper support structure 60 may be provided with a single, outwardly extending, substantially horizontal shoulder 70. In this embodiment, the two outwardly projected corners 72 of the shoulder 70 are bent slightly upward to provide two points of engagement where the upward turned corners 72 of the outwardly extending shoulder 70 will engage and bite into a portion of the underside of one of the roofing panels forming the standing seam. Again, as before, the horizontally extending shoulder 70 is configured to support at least a portion of the interior surface of a roofing panel forming the standing seam. In this manner, the clip will again provide a strong, secure connection between the standing seam formed by a pair of adjacent metallic roofing panels and a purlin extending beneath the metallic panels. In this particular embodiment of the present invention, the upwardly extending surface 68 of the upper support structure 60 will extend across the entire width of the support structure 60, as will the outwardly extending shoulder 70. Further, in this embodiment of the present invention, the horizontally extending shoulder 70 will project outwardly from a face of the top piece 60 at a substantially right angle to the body of the top piece 60.

As is seen in FIGS. 5 and 6, in this embodiment of the present invention, the various components of the clip may be conveniently held together by rivets 66. FIG. 7 depicts both the rotational and translational movement capabilities of a clip according to this embodiment of the present invention.

Referring again to FIGS. 3 and 4, a clip 10 according to the present invention will be provided with an articulating bearing member, or middle piece, 14 which is configured to facilitate both the translational and rotational movement of the clip, while coupling the several components of the clip together. Referring specifically to FIG. 4, according to the present invention the articulating bearing member 14 will be provided with a longitudinal slot 34 provided along the top of the member 14 to facilitate longitudinal, translational movement of the upper support structure 12 relative to the articulating bearing member 14. The articulating bearing member 14 is further provided with an aperture 38 located at the bottom of the middle piece 14 and along the vertical center line of the middle piece 14, to facilitate rotational movement of the upper support structure relative to the rigid base 16 of the clip 10.

In a preferred embodiment of the invention, the longitudinal slot 34 will extend at least halfway through the width of the middle piece 14 so that when the top piece 12 is attached to the middle piece 14 by suitable connecting means 18, the top piece 12 will be able to be displaced a suitable longitudinal distance relative to the middle piece 14.

Referring still again to FIGS. 3 and 4, and specifically FIG. 4, a clip according to the present invention will be further provided with a rigid base 16. Rigid base 16 will be preferably be provided with an upstanding vertical surface 40 which supports the other components 12 and 14 of the clip. The base will also be preferably provided with a substantially horizontal surface 42 which may be adapted to engage a purling to anchor the clip 10 to a selected portion of the structure to be roofed. In this preferred embodiment, the horizontal portion 42 of the rigid base 16 will be provided with a plurality of holes 46 which will receive connectors such as screws or bolts 51, in order to anchor the base 16 of the clip 10 to a purlin of the structure.

Referring now to FIG. 2, a clip 10 is shown supporting a standing seam formed by two adjoining roofing panels 22 and 24. In this view, the base 16 of the clip 10 is shown anchoring the clip 10 to a purlin 50 by means of a fastener 51.

As will be apparent to one skilled in the art, the same distinctive characteristics of a clip according to the present invention (namely the ability to accommodate both translation and rotational displacement) may be accomplished by providing the slot 34 along the bottom of the articulating bearing member 14 and by providing a pair of apertures in the upstanding vertical surface 40 of the rigid base 16 so that the articulating bearing member may be slidably, translationally displaced relative to the rigid base 16. In this embodiment, matching apertures would be provided proximate the top of the articulating bearing member 14 and the bottom, downwardly projecting vertical portion of the upper support structure 12 so that the upper support structure 12 may be rotationally displaced relative to said articulating bearing member 14.

Referring now to FIGS. 1 and 2, when an articulating clip 10 according to the present invention is used to support a standing seam roof assembly, the base 16 of the clip 10 is used to anchor the clip 10 to the top of a purlin 50. The clip according to the present invention again being distinguishable in that it is capable of both translational and rotational movement in a vertical plane relative to the rigid purlin 50. The clip 10 is then used to support a portion of the interior of a standing seam 20, formed by adjacent roofing panels 22 and 24, with the uppermost portion 12 of the clip 10. The upper support structure 12 of the clip 10 is further provided with substantially horizontally extending shoulders 32 which provide additional support to a portion of the interior surface of one of the roofing panels 24 forming the standing seam 20.

Referring now specifically to FIG. 1, when a clip 10 according to the present invention is in place and used to support a standing seam 20 of a roofing system composed in part by roofing panels 24 and 22, the clip 10 will allow for longitudinal movement of the standing seam 20 relative to the purlin 50 upon which it is rigidly anchored without jeopardizing the integrity of the roofing system by tearing the sealant placed in the standing seam formed by the roofing panels. Further, the novel clip 10 according to the present invention will also be able to provide for rotational movement of the standing seam 20 relative to the substantially rigid purlin 50 without affecting the ability of the clip to accommodate translational movement caused by expansion and contraction of the roofing panels.

Various modifications and improvements may be made to the disclosed embodiments without departing from the overall scope and spirit of the invention. For example, the lower portion of the upper support structure of the clip may be of increased material thickness in order to improve the overall strength of the clip, or the middle piece and rigid base may be of slightly different geometric shapes while still providing the same novel articulating features associated with a clip according to the present invention.

Having therefore fully and completely disclosed the best mode of our invention, we now claim:

1. A clip to attach a portion of standing seam roofing system to a substantially rigid purlin, while accommodating movement of the roofing system relative to the rigid purlin, comprising:

an upper support structure, adapted to engage a portion of a standing seam of said roofing system to securely attach said clip to said roofing system, said upper support structure also providing support to a portion of a roofing panel forming said standing seam;

a rigid base to support said clip and anchor said clip to said purlin;

an articulating bearing member, disposed intermediate said upper support structure and said rigid base to connect said upper support structure to said rigid base of the clip together in a manner so as to enable both rotational and translational articulation of said upper support structure relative to said rigid base and purlin; and connecting means to connect said upper support structure to said articulating bearing member, and to connect said articulating bearing member to said rigid base.

2. The clip according to claim 1, wherein said articulating bearing member is further defined by a top and a bottom and is provided with a longitudinal slot positioned proximate the top of said articulating member, and wherein said upper support structure is provided with at least two apertues positioned so that said connecting means connect said upper support member to said articulating bearing member so that said upper support structure may be translationally displaced relative to said articulating bearing member; and wherein said bottom of said articulating bearing member is provided with an aperture, proximate the center line of said member, which coincides with a similarly positioned aperture in a vertical surface provided on said rigid base, so that when said connecting means connect said articulating bearing member to said rigid base, said articulating bearing member may be rotationally displaced relative to said rigid base.

3. The clip according to claim 1, wherein said articulating bearing member is further defined by a top and a bottom and is provided with a longitudinal slot positioned proximate said bottom of said articulating bearing member, and wherein said rigid base is provided with at least two apertues in a vertical surface provided on said rigid base, so that when said connecting means connect said articulating bearing member to said rigid base, said articulating bearing member may be translationally displaced relative to said rigid base; and wherein said top of said articulating bearing member is provided with an aperture, proximate the center line of said member, which coincides with a similarly positioned aperture in a bottom portion of said upper support structure, so that when said connecting means connect said articulating bearing member to said upper support structure, said upper support structure may be rotationally displaced relative to said articulating bearing member.

4. A clip, used to support a standing seam, formed by adjacent roofing panels, on a purlin, comprising:

a top piece having an upwardly extending portion adapted to engage a portion of said standing seam, a pair of opposed, horizontally extending shoulders adapted to support a portion interior of one of the roofing panels forming said standing seam, and a downwardly projecting bottom portion provided with a pair of opposed apertures;

a middle movement facilitating piece, said middle piece having a top, a bottom, a longitudinal slot proximate said top and an aperture proximate said bottom;

an L-shaped base including a substantially vertical surface and a substantially horizontal surface, said substantially vertical surface being provided with an aperture alignable with the aperture in the faciliating piece, said substantially horizontal surface being engageable with a portion of said purlin; and first connecting means extending through said slot in said middle movement facilitating piece and said opposed apertures in said moveable top piece to hold said middle piece and said top piece in close proximal relation to one another while allowing said top piece to be slideably displaceable relative to said middle piece; and second connecting means extending through said aperture in said substantially vertical surface of said base and said aperture in said middle piece to hold said middle piece in close proximal relation to said base and to enable said middle piece to be rotatably displaceable relative to said base.

5. The clip according to claim 4, wherein said top piece is further defined by a total width measured along said top piece, and wherein said horizontally extending shoulders of said movable top piece comprise a portion of said total width and extended outwardly, substantially horizontally from a common face of said top piece, the combined width of said shoulders comprising no more than one half of the total width of said top piece.

6. The clip according to claim 5, wherein two horizontally extending shoulders are provided in opposed relation about said upwardly extending portion of said top piece.

7. The clip according to claim 4, wherein the thickness of said bottom portion of said top piece is twice as thick as the thickness of said upper upwardly extending portion of said top piece.

8. The clip according to claim 4, wherein said slot provided in said middle movement facilitating piece extends at least through half of the width of said middle piece, the transverse center of said slot being positioned along the vertical center line of said middle piece; the vertical width of said slot being slightly larger than the diameter of said apertures in said top piece.

9. The clip according to claim 4, wherein said connecting means are rivets.

10. The clip according to claim 4, wherein said connecting means are nut and bolt combinations.

11. A clip for assembly of two roofing panels, interconnected by a standing seam, on a purlin, comprising:

a bracket, attachable to a purlin, and configured to fit within and engage said standing seam;

said bracket including a separate central component, an upper component and a lower component, said central component disposed inbetween, and interconnecting, said upper component and said lower component, said central component being pivotally connected to said lower component to provide for relative rotational movement between said lower component and said upper component;

said lower component being attachable to said purlin and said upper component configured to fit within and engage said standing seam.

12. The clip according to claim 11, wherein said central component and said upper component are longitudinally moveable relative to one another.

13. A clip, used to support a standing seam, formed by adjacent roofing panels, on a purlin, comprising:

a top piece having an upwardly extending portion adapted to engage a portion of said standing seam, and a horizontally extending shoulder adapted to support a portion of a roofing panel forming said standing seam, said shoulder extending along the length of the top piece, said top piece also having a downwardly projecting bottom portion provided with a pair of opposed apertures;

a middle movement facilitating piece, said middle piece having a top, a bottom, a longitudinal slot approximate said top, and an aperture proximate said bottom;

an L-shaped base including a substantially vertical surface and a substantially horizontal surface, said substantially vertical surface being provided with an aperture alignable with said aperture in the middle movement facilitating piece, said substantially horizontal surface being engageable with at least a portion of said purlin; and first connecting means extending through said slot in said middle movement facilitating piece and said opposed apertures in said movable top piece to hold said middle piece and said top piece in close proximal relation to one another while allowing said top piece to be slidably displaceable relative to said middle piece; and second connecting means extending through said aperture in said substantially vertical surface of said base and said aperture in said middle piece in close proximal relation to said base and to enable said middle piece to be rotatably displaceable relative to said base.

14. A clip for attaching a standing seam metallic roof to a purlin wherein adjacent longitudinal edges to two adjacent roof panels in the roof are joined together to form a standing longitudinal seam, the interior of the seam facing toward the purlin, comprising:

an upper support structure positionable below the standing seam and configured to extend upward to engage the seam along the interior of the seam, said upper support structure including a shoulder extending horizontally to engage a portion of one of the two adjacent panels;

an L-shaped base having an upward extending first leg and a horizontally extending second leg, said second leg adapted to be attached securely to the purlin; and a bearing member between the upper support structure and the L-shaped base, said bearing member interconnecting said upper support structure and said first leg of said base in a manner to enable both longitudinally slideable and rotational movements of said support stucture and said base relative to one another.

* * * * *

UNITED STATES PATENT AND TRADEMARK OFFICE

CERTIFICATE OF CORRECTION

PATENT NO. : 4,796,403

DATED : January 10, 1989

INVENTOR(S) : David A. Fulton and Jerry D. Boen

It is certified that error appears in the above-identified patent and that said Letters Patent is hereby corrected as shown below:

Claim 1, line 1, after "of", please insert --a--.

Signed and Sealed this

Twenty-ninth Day of August, 1989

*Attest:*

DONALD J. QUIGG

*Attesting Officer*

*Commissioner of Patents and Trademarks*